US008993499B2

(12) United States Patent
Campbell et al.

(10) Patent No.: US 8,993,499 B2
(45) Date of Patent: Mar. 31, 2015

(54) LOW TEMPERATURE PERFORMANCE LUBRICATING OIL DETERGENTS AND METHOD OF MAKING THE SAME

(75) Inventors: Curt B. Campbell, Hercules, CA (US); Gilles P. Sinquin, Saint Martin du Manoir (FR); Eugene E. Spala, Fairfield, CA (US); Gilbert R. Chapon, Montivilliers (FR)

(73) Assignees: Chevron Oronite Company LLC, San Ramon, CA (US); Chevron Oronite S.A., Cedex (FR)

( * ) Notice: Subject to any disclaimer, the term of this patent is extended or adjusted under 35 U.S.C. 154(b) by 834 days.

(21) Appl. No.: 12/339,894

(22) Filed: Dec. 19, 2008

(65) Prior Publication Data

US 2009/0170737 A1 Jul. 2, 2009

Related U.S. Application Data

(60) Provisional application No. 61/017,251, filed on Dec. 28, 2007.

(51) Int. Cl.
*C10M 159/20* (2006.01)
*C10M 159/22* (2006.01)

(52) U.S. Cl.
CPC ..... *C10M 159/20* (2013.01); *C10M 159/22* (2013.01); *C10M 2203/1025* (2013.01); *C10M 2207/262* (2013.01); *C10M 2215/28* (2013.01); *C10M 2219/044* (2013.01); *C10M 2223/045* (2013.01); *C10N 2210/06* (2013.01); *C10N 2220/028* (2013.01); *C10N 2230/02* (2013.01); *C10N 2230/04* (2013.01); *C10N 2240/02* (2013.01); *C10N 2240/04* (2013.01); *C10N 2270/00* (2013.01)
USPC ..... 508/460; 562/471; 568/716

(58) Field of Classification Search
USPC ..... 508/460; 562/471; 568/716
See application file for complete search history.

(56) References Cited

U.S. PATENT DOCUMENTS

| | | | | |
|---|---|---|---|---|
| 5,895,777 | A | 4/1999 | Ueda et al. | |
| 6,162,770 | A | 12/2000 | Le Coent et al. | |
| 6,337,310 | B1 * | 1/2002 | Campbell et al. | 508/391 |
| 6,670,513 | B1 * | 12/2003 | Campbell et al. | 568/793 |
| 7,951,760 | B2 * | 5/2011 | Le Coent | 508/460 |
| 2006/0052259 | A1 | 3/2006 | Le Coent et al. | |
| 2007/0027044 | A1 * | 2/2007 | Le Coent | 508/460 |
| 2007/0117726 | A1 | 5/2007 | Cartwright | |

FOREIGN PATENT DOCUMENTS

| | | | |
|---|---|---|---|
| EP | 0440507 | A | 8/1991 |
| EP | 0985726 | A1 | 3/2000 |
| EP | 1798278 | A | 6/2007 |
| EP | 1154012 | B1 | 3/2008 |
| GB | 734598 | | 8/1955 |
| GB | 734622 | | 8/1955 |
| GB | 738359 | | 10/1955 |
| GB | 786167 | | 11/1957 |
| GB | 793050 | A | 4/1958 |
| GB | 1146925 | | 3/1969 |
| WO | 8803133 | A1 | 5/1988 |

OTHER PUBLICATIONS

Rosemarie Szostak; Handbook of Molecular Sieves; 1992; pp. 295, 300, 343, 349, 372, 373, 409, 410, 421, 447, 448, 455, 460, 538, 539, and 545, Van Nostrand Reinhold, New York.

API Publication 1509, Engine Oil Licensing and Certification System, 14th Edition, Addendum I; API categories I, II, III, IV and V; Dec. 1998, Washington, D. C.

* cited by examiner

*Primary Examiner* — James Goloboy

(57) ABSTRACT

A carboxylate detergent prepared by the process comprising (a) alkylating a hydroxyaromatic compound with at least one normal alpha olefin having from about 12 to about 30 carbon atoms per molecule that has been isomerized to obtain an isomerized alpha olefin having 15-98 wt % branching and a residual alpha olefin content of between from about 0.1 to about 30 wt %, thereby producing an alkylated hydroxyaromatic compound; (b) neutralizing the resulting alkylated hydroxyaromatic compound with an alkali metal base; (c) carbonating the alkali metal salt from step (b) with carbon dioxide; (d) acidifying the salt produced in step (c); and (e) overbasing the resulting alkylated hydroxyaromatic carboxylic acid.

16 Claims, No Drawings

LOW TEMPERATURE PERFORMANCE LUBRICATING OIL DETERGENTS AND METHOD OF MAKING THE SAME

FIELD OF THE INVENTION

The present invention is directed to low temperature performance lubricating oils and a method of making the same. These detergents exhibit superior performance at low temperatures.

BACKGROUND OF THE INVENTION

Overbased detergents are well described to provide lubricating properties. Often such detergent additives are proportioned with other lubricating additives to provide lubricating oil compositions that exhibit certain desired lubricating properties.

Alkaline-earth metal hydroxybenzoates are also known as additives for engine lubricating oils.

DESCRIPTION OF THE RELATED ART

U.S. Pat. No. 5,895,777 describes lubricating oil additives comprising the alkaline-earth metal salts of aromatic carboxylic hydroxy acids containing carboxylic acids having 16 to 36 carbon atoms.

U.S. Patent Application Publication No. US 2007/0027044 describes a process for preparing an overbased alkali metal alkylhydroxybenzoate, said process comprising overbasing an alkali metal alkylhydroxybenzoate or a mixture of alkali metal alkylhydroxybenzoate and up to 50 mole % of alkylphenol, based on the total mixture of alkylhydroxybenzoate and alkylphenol, with a molar excess of alkaline earth metal base and at least one acidic overbasing material in the presence of at least one carboxylic acid having from one to four carbon atoms and a solvent selected from the group consisting of aromatic hydrocarbons, aliphatic hydrocarbons, monoalcohols and mixtures thereof.

European Patent Application No. 1,154,012 describes lubricating compositions comprising an oil, an anti-wear additive and a sole oil-soluble overbased detergent comprising an aromatic carboxylate, such as a calcium salicylate substituted by a hydrocarbon remainder.

British Patent No. 1,146,925 describes lubricating compositions comprising, as lubricating agents, polyvalent metal salts, in particular calcium, and alkylsalicylic acids comprising more than 12, preferably 14 to 18 carbon atoms in the alkyl group. These salts can be prepared from the corresponding sodium salts, as synthesis intermediates.

British Patent No. 786,167 describes polyvalent metal salts of oil-soluble organic acids, such as sulfonic hydrocarbons, naphthenic acids or alkylhydroxybenzoic acids, in particular alkylsalicylic acids having an alkyl radical of up to 22 carbon atoms. The alkylsalicylic acids can be prepared from sodium alkylsalicylic acids according to the processes described in British Patents Nos. 734,598; 734,622 and 738,359. The sodium alkylsalicylates described in these British patents are useful as synthetic intermediates for the preparation of alkaline-earth alkylsalicylates, which are also useful as additives for lubricating oil.

In general, the above references describe processes for aromatic hydroxy carboxylic acids and their salts which are derived from alkaline salts of phenol derivatives, such as phenol itself, cresols, mono- and dialkylphenols, the alkyl group having from about 8 to 18 carbon atoms, halogenated phenols, aminophenols, nitrophenols, 1-naphthol, 2-naphthol, halogenated naphthols, and the like. The processes described above, however, lead to products having high sediment content at high TBN that decrease product yield and create added disposal expense. Thus, it is desirable to have a process that improves product yield by minimizing the sediment resulting from such processes.

SUMMARY OF THE INVENTION

In one embodiment, the present invention is directed to a carboxylate detergent prepared by the process comprising (a) alkylating a hydroxyaromatic compound with at least one normal alpha olefin having from about 12 to about 30 carbon atoms per molecule that has been isomerized to obtain an isomerized alpha olefin having 15-98 wt % branching and a residual alpha olefin content of between from about 0.1 to about 30 wt %, thereby producing an alkylated hydroxyaromatic compound;

(b) neutralizing the resulting alkylated hydroxyaromatic compound with an alkali metal base to provide an alkali metal salt of the alkylated hydroxyaromatic compound;

(c) carbonating the alkali metal salt from step (b) with carbon dioxide thereby producing an alkylated hydroxyaromatic carboxylic acid alkali metal salt;

(d) acidifying the salt produced in step (c) with acid to produce the alkylated hydroxyaromatic carboxylic acid; and (e) overbasing the alkylated hydroxyaromatic carboxylic acid with lime in the presence of carbon dioxide thereby producing an overbased alkylated hydroxyaromatic carboxylate detergent.

In another embodiment, the present invention it directed to a carboyxiate detergent having the following structure:

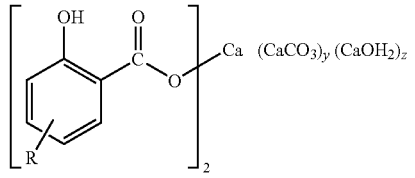

wherein R is an alkyl group derived from an isomerized alpha olefin having from about 12 to about 30 carbon atoms per molecule, having 15-98 wt % branching and a residual alpha olefin content of between from about 0.1 to about 30 wt %; and wherein y and z are independently whole of partial integers.

Another embodiment of the present invention is directed to an alkylated hydroxyaromatic compound prepared by a process comprising alkylating a hydroxyaromatic compound with at least one normal alpha olefin having from about 12 to about 30 carbon atoms per molecule that has been isomerized to obtain an isomerized alpha olefin having 15-98 wt % branching and a residual alpha olefin content of between from about 0.1 to about 30 wt %, thereby producing an alkylated hydroxyaromatic compound.

DETAILED DESCRIPTION OF THE INVENTION

While the invention is susceptible to various modifications and alternative forms, specific embodiments thereof are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DEFINITIONS

Metal—The term "metal" refers to alkali metals, alkaline earth metals, or mixtures thereof.

Alkali Metal Base—The term "alkaline metal base" refers to potassium, sodium, lithium or mixtures thereof.

Olefins—The term "olefins" refers to a class of unsaturated aliphatic hydrocarbons having one or more carbon-carbon double bonds, obtained by a number of processes. Those containing one double bond are called mono-alkenes, and those with two double bonds are called dienes, alkyldienes, or diolefins. Alpha olefins are particularly reactive because the double bond is between the first and second carbons. Examples are 1-octene and 1-octadecene, which are used as the starting point for medium-biodegradable surfactants. Linear and branched olefins are also included in the definition of olefins.

Linear Olefins—The term "linear olefins," which include normal alpha olefins and linear alpha olefins, refers to olefins which are straight chain, non-branched hydrocarbons with at least one carbon-carbon double bond present in the chain.

Double-Bond Isomerized Linear Olefins—The term "double-bond isomerized linear olefins" refers to a class of linear olefins comprising more than 5% of olefins in which the carbon-carbon double bond is not terminal (i.e., the double bond is not located between the first and second carbon atoms of the chain).

Partially Branched Linear Olefins—The term "partially branched linear olefins" refers to a class of linear olefins comprising less than one alkyl branch per straight chain containing the double bond, wherein the alkyl branch may be a methyl group or higher. Partially branched linear olefins may also contain double-bond isomerized olefin.

Branched Olefins—The term "branched olefins" refers to a class of olefins comprising one or more alkyl branches per linear straight chain containing the double bond, wherein the alkyl branch may be a methyl group or higher. The term "branched" is used interchangeably with "isomerized." Isomerization is the process in which linear olefins are reacted under reactive conditions and in the presence of a catalyst to form branched olefins.

$C_{12}$-$C_{30}^{+}$ Normal Alpha Olefins—This term defines a fraction of normal alpha olefins wherein the carbon numbers below 12 have been removed by distillation or other fractionation methods.

Carboxylate Detergent

One embodiment of the present invention is directed to a carboxylate detergent having the following structure:

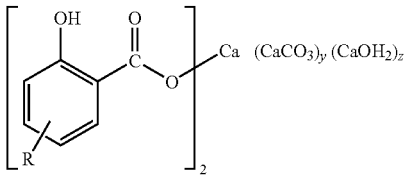

wherein R is an alkyl group derived from an isomerized alpha olefin having from about 12 to about 30 carbon atoms per molecule, having 15-98 wt % branching and a residual alpha olefin content of between from about 0.1 to about 30 wt %; and wherein y and z are independently whole or partial integers.

Process for Preparing the Carboxylate

Another embodiment of the present invention is a carboxylate detergent which is prepared by the process described herein.

Aromatic Compound

At least one hydroxyaromatic compound or a mixture of hydroxyaromatic compounds may be used for the alkylation reaction in the present invention. Preferably the at least one hydroxyaromatic compound or the hydroxyaromatic compound mixture comprises at least one of monocyclic hydroxyaromatics, such as phenol, cresol, or mixtures thereof. The at least one hydroxyaromatic compound or hydroxyaromatic compound mixture may also comprise bicyclic and poly-cyclic hydroxyaromatic compounds, such as 2-naphthol. More preferably, the at least one hydroxyaromatic compound or hydroxyaromatic compound mixture is phenol, including all isomers.

Sources of Aromatic Compound

The at least one hydroxyaromatic compound or the mixture of hydroxyaromatic compounds employed in the present invention is prepared by methods that are well known in the art.

Olefins

Sources of Olefins

The olefins employed in this invention may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

Normal Alpha Olefins

Preferably, the mixture of linear olefins that may be used for the alkylation reaction is a mixture of normal alpha olefins selected from olefins having from about 12 to about 30 carbon atoms per molecule. More preferably the normal alpha olefin mixture is selected from olefins having from about 14 to about 28 carbon atoms per molecule. Most preferably, the normal alpha olefin mixture is selected from olefins having from about 18 to about 24 carbon atoms per molecule.

In one embodiment of the present invention, the normal alpha olefins (NAO) are isomerized using at least one of a solid or liquid catalyst. The NAO isomerization process can be either a batch, semi-batch, continuous fixed bed or combination of these processes using homogenous or heterogenous catalysts. A solid catalyst preferably has at least one metal oxide and an average pore size of less than 5.5 angstroms. More preferably, the solid catalyst is a molecular sieve with a one-dimensional pore system, such as SM-3, MAPO-11, SAPO-11, SSZ-32, ZSM-23, MAPO-39, SAPO-39, ZSM-22 or SSZ-20. Other possible solid catalysts useful for isomerization include ZSM-35, SUZ-4, NU-23, NU-87 and natural or synthetic ferrierites. These molecular sieves are well known in the art and are discussed in Rosemarie Szostak's Handbook of Molecular Sieves (New York, Van Nostrand Reinhold, 1992) which is herein incorporated by reference for all purposes. A liquid type of isomerization catalyst that can be used is iron pentacarbonyl ($Fe(CO)_5$).

The process for isomerization of normal alpha olefins may be carried out in batch or continuous mode. The process temperatures may range from about 50° C. to about 250° C. In the batch mode, a typical method used is a stirred autoclave or glass flask, which may be heated to the desired reaction temperature. A continuous process is most efficiently carried out in a fixed bed process. Space rates in a fixed bed process can range from 0.1 to 10 or more weight hourly space velocity.

In a fixed bed process, the isomerization catalyst is charged to the reactor and activated or dried at a temperature of at about 150° C. under vacuum or flowing inert, dry gas. After activation, the temperature of the isomerization catalyst is adjusted to the desired reaction temperature and a flow of the olefin is introduced into the reactor. The reactor effluent containing the partially-branched, isomerized olefins is collected. The resulting partially-branched, isomerized olefins contain a different olefin distribution (i.e., alpha olefin, beta olefin; internal olefin, tri-substituted olefin, and vinylidene olefin) and branching content that the unisomerized olefin and conditions are selected in order to obtain the desired olefin distribution and the degree of branching.

The resulting isomerized alpha olefin (IAO) is composed of between from about 20 to about 98 wt % branching, preferably from about 45 to about 80 wt % branching and most preferred from about 60 to about 70 wt % branching and between from about 0.1 to about 30 wt % residual alpha olefin, preferably between from about 0.2 to about 20 wt % residual alpha olefin and most preferably between from about 0.5 to about 10 wt % residual alpha olefin species.

In one embodiment, the IAO is composed of at least about 23% branching, at least about 9% residual alpha olefin, and having from about 20 to about 24 carbon atoms.

In another embodiment, the IAO is composed of at least about 65% branching, at least about 0.5% residual alpha olefin and having from about 20 to about 24 carbon atoms.

In one embodiment, the isomerized alpha olefin is a partially isomerized olefin containing a residual alpha olefin content, wherein when the percent branching in the partially isomerized alpha olefin is less than or equal to 25 weight percent, then the residual alpha olefin content in such partially isomerized alpha olefin is greater than or equal to 8 weight percent.

Acid Catalyst

Typically, the alkylated aromatic compound may be prepared using strong acid catalysts (Bronsted or Lewis acids). The term "strong acid" refers to an acid having a $pK_a$ of less than about 4. The term "strong acid" is also meant to include mineral acids stronger than hydrochloric acid and organic acids having a Hammett acidity value of at least minus 10 or lower, preferably at least minus 12 or lower, under the same conditions employed in context with the herein described invention. The Hammett acidity function is defined as:

$$H_o = pK_{BH+} - \log(BH^+/B)$$

where B is the base and $BH^+$ its protonated form, $pK_{BH+}$ is the dissociation constant of the conjugate acid and $BH^+/B$ is the ionization ratio; lower negative values of $H_o$ correspond to greater acid strength.

Preferably, the strong acid catalyst is selected from a group consisting of hydrochloric acid, hydrofluoric acid, hydrobromic acid, sulfuric acid, perchloric acid, trifluoromethane sulfonic acid, fluorosulfonic acid, and nitric acid. Most preferred, the strong acid catalyst is hydrofluoric acid.

The alkylation process may be carried out in a batch or continuous process. The strong acid catalyst may be recycled when used in a continuous process. The strong acid catalyst may be recycled or regenerated when used in a batch process or a continuous process.

The strong acid catalyst may be regenerated after it becomes deactivated (i.e., the catalyst has lost all or some portion of its catalytic activity). Methods that are well known in the art may be used to regenerate the deactivated hydrofluoric acid catalyst.

Process for Preparing the Alkylated Aromatic Compound

In one embodiment of the present invention, the alkylation process is carried out by reacting a first amount of at least one hydroxyaromatic compound or a mixture of hydroxyaromatic compounds with a mixture of isomerized olefin compounds in the presence of a strong acid catalyst, such as hydrofluoric acid, in a reactor in which agitation is maintained, thereby producing a reaction product. The strong acid catalyst may be recycled to the reactor(s) in a closed loop cycle. The reaction product is further treated to remove excess un-reacted hydroxyaromatic compounds and, optionally, olefinic compounds from the desired alkylate product. The excess hydroxyaromatic compounds may also be recycled to the reactor(s).

The total charge mole ratio of hydrofluoric acid to the mixture of olefin compounds is about 1.0 to 1.

The total charge mole ratio of the aromatic compound to the mixture of olefin compounds is about 7.5 to 1.

Many types of reactor configurations may be used for the reactor zone. These include, but are not limited to, batch and continuous stirred tank reactors, reactor riser configurations, ebulating bed reactors, and other reactor configurations that are well known in the art. Many such reactors are known to those skilled in the art and are suitable for the alkylation reaction. Agitation is critical for the alkylation reaction and can be provided by rotating impellers, with or without baffles, static mixers, kinetic mixing in risers, or any other agitation devices that are well known in the art.

The alkylation process may be carried out at temperatures from about 0° C. to about 100° C. The process is carried out under sufficient pressure that a substantial portion of the feed components remain in the liquid phase. Typically, a pressure of 0 to 150 psig is satisfactory to maintain feed and products in the liquid phase.

The residence time in the reactor is a time that is sufficient to convert a substantial portion of the olefin to alkylate product. The time required is from about 30 seconds to about 30 minutes. A more precise residence time may be determined by those skilled in the art using batch stirred tank reactors to measure the kinetics of the alkylation process.

The at least one hydroxyaromatic compound or mixture of hydroxyaromatic compounds and the mixture of olefins may be injected separately into the reaction zone or may be mixed prior to injection. Both single and multiple reaction zones may be used with the injection of the aromatic compounds and the mixture of isomerized olefins into one, several, or all reaction zones. The reaction zones need not be maintained at the same process conditions.

The hydrocarbon feed for the alkylation process may comprise a mixture of hydroxyaromatic compounds and a mixture isomerized olefins in which the molar ratio of hydroxyaromatic compounds to isomerized olefins is from about 0.5:1 to about 50:1 or more. In the case where the molar ratio of hydroxyaromatic compounds to isomerized olefin is >1.0 to 1, there is an excess amount of hydroxyaromatic compounds present. Preferably an excess of hydroxyaromatic compounds is used to increase reaction rate and improve product selectivity. When excess hydroxyaromatic compounds are used, the excess un-reacted hydroxyaromatic in the reactor effluent can be separated, e.g. by distillation, and recycled to the reactor.

The alkyl group on the alkyl hydroxyaromatic compound comprises a branched alkyl group having between from about 15 to about 98 wt % branching, preferably from about 30-80 wt % branching, more preferred from about 45 to about 70 wt % branching and most preferred from about 50 to about 60 wt % branching and between from about 0.1 to about 30 wt % residual alpha olefin, preferably between from about 0.2 to about 20 wt % residual alpha olefin and most preferably between from about 0.5 to about 10 wt % residual alpha olefin species.

The use of a hydroxyaromatic compound having from about 15 to about 98 wt % branching is particularly attractive because we have discovered that the percent branching and the length of the isomerized alpha olefin promotes superior low temperature performance when employed as an additive in lubricating oil compositions.

As disclosed herein, isomerized hydroxyaromatic compound may be obtained by reaction of the hydroxyaromatic compound with an isomerized normal alpha olefin, having from about 12 to about 30 carbon atoms per molecule. Typically, the alkylated hxdroxyaromatic compound comprises a mixture of monosubstituted isomers, the great majority of the substituents being in the para position, very few being in the ortho position, and hardly any in the meta position. That makes them relatively reactive towards an alkaline earth metal base, since the phenol function is practically devoid of steric hindrance.

Additionally, when the normal alpha olefins do not completely react to form isomerized alpha olefins, residual alpha olefins are obtained. The residual alpha olefins may also react with the hydroxyaromatic compounds to form an alkylated hydroxyaromatic compound having a linear alkyl radical. The alkylated hydroxyaromatic compounds having a linear alkyl radical may comprise a mixture of monosubstituted isomers in which the proportion of linear alkyl substituents in the ortho, para, and meta positions is much more uniformly distributed. This makes them much less reactive towards an alkaline earth metal base since the phenol function is much less accessible due to considerable steric hindrance, due to the presence of closer and generally heavier alkyl substituents.

Neutralization Step

The alkylated hydroxyaromatic compound, as described above, is neutralized using an alkali metal base, including but not limited to oxides or hydroxides of lithium, sodium or potassium. In a preferred embodiment, potassium hydroxide is preferred. In another preferred embodiment, sodium hydroxide is preferred, Neutralization of the alkylated hydroxyaromatic compound takes place, preferably, in the presence of a light solvent, such as toluene, xylene isomers, light alkylbenzene or the like, to form an alkali metal salt of the alkylated hydroxyaromatic compound. In one embodiment, the solvent forms an azeotrope with water. In another embodiment, the solvent may also be a mono-alcohol such as 2-ethylhexanol. In this case, the 2-ethylhexanol is eliminated by distillation before carboxylation. The objective with the solvent is to facilitate the elimination of water.

This step is carried out at a temperature high enough to eliminate water. In one embodiment, the product is put under a slight vacuum in order to require a lower reaction temperature.

In one embodiment, xylene is used as a solvent and the reaction conducted at a temperature between 130° C. and 155° C., under an absolute pressure of 800 mbar ($8*10^4$ Pa).

In another embodiment, 2-ethylhexanol is used as solvent. As the boiling point of 2-ethylhexanol (184° C.) is significantly higher than xylene (140° C.), the reaction is conducted at a temperature of at least 150.degree. C.

The pressure is reduced gradually below atmospheric in order to complete the distillation of water reaction. Preferably, the pressure is reduced to no more than 70 mbar ($7*10^3$ Pa).

By providing that operations are carried out at a sufficiently (high temperature and that the pressure in the reactor is reduced gradually below atmospheric, the neutralization reaction is carried out without the need to add a solvent and forms an azeotrope with the water formed during this reaction). In this case, temperature is heated up to 200° C. and then the pressure is reduced gradually below atmospheric. Preferably the pressure is reduced to no more than 70 mbar ($7*10^3$ Pa).

Elimination of water is done over a period of at least 1 hour, preferably at least 3 hours.

The quantities of reagents used should correspond to the following molar ratios: alkali metal base:alkylated hydroxyaromatic compound from about 0.5:1 to 1.2:1, preferably from about: 0.9:1 to 1.05:1 solvent:alkylated hydroxyaromatic compound (vol:vol) from about 0.1:1 to 5:1, preferably from about 0.3:1 to 3:1 B.

Carboxylation

The carboxylation step is conducted by simply bubbling carbon dioxide ($CO_2$) into the reaction medium originating from the preceding neutralization step and is continued until at least 50% of the starting alkylated hydroxyaromatic compound has been converted to alkylhydroxybenzoic acid (measured as hydroxybenzoic acid by potentiometric determination).

At least 50 mole %, preferably 75 mole %, more preferably 85 mole % of the starting alkylated hydroxyaromatic compound is converted to alkylhydroxylbenzoate using carbon dioxide at a temperature between about 110° C. and 200° C. under a pressure within the range of from about atmospheric to 15 bar ($15*10^5$ Pa), preferably from 1 bar ($1*10^5$ Pa) to 5 bar ($5*10^5$ Pa), for a period between about 1 and 8 hours.

In one variant with potassium salt, temperature is preferably between about 125° C. and 165° C. and more preferably between 130° C. and 155° C., and the pressure is from about atmospheric to 15 bar ($15*10^5$ Pa), preferably from about atmospheric to 4 bar ($4*10^5$ Pa).

In another variant with sodium salt, temperature is directionally lower preferably between from about 110° C. and 155° C., more preferably from about 120° C. and 140° C. and the pressure from about 1 bar to 20 bar ($1*10^5$ to $20*10^5$ Pa), preferably from 3 bar to 15 bar ($3*10^5$ to $15*10^5$ Pa).

The carboxylation is usually carried out, diluted in a solvent such as hydrocarbons or alkylate, e.g., benzene, toluene, xylene and the like. In this case, the weight ratio of solvent: hydroxybenzoate (i.e., alkali metal salt of the alkylated hydroxyaromatic compound) is from about 0.1:1 to 5:1, preferably from about 0.3:1 to 3:1.

In another variant, no solvent is used. In this case, carboxylation is conducted in the presence of diluent oil in order to avoid a too viscous material.

The weight ratio of diluent oil:alkylhydroxybenzoate is from about 0.1:1 to 2:1, preferably from about 0.2:1 to 1:1 and more preferably from about 0.2:1 to 0.5:1.

Acidification

The alkylated hydroxyaromatic carboxylic acid alkali metal salt produced above is then contacted with at least one acid capable of converting the alkali metal salt to an alkylated hydroxyaromatic carboxylic acid. Such acids are well known in the art to acidify the aforementioned alkali metal salt.

Overbasing

Overbasing of the alkylated hydroxyaromatic carboxylic acid may be carried out by any method known by a person skilled in the art to produce an overbased alkylated hydroxyaromatic carboxyate detergent.

In one embodiment of the invention, the overbasing reaction is carried out in a reactor by reacting the alkylated hydroxyaromatic carboxylic acid with lime (i.e., alkaline earth metal hydroxide) in the presence of carbon dioxide, in the presence of an aromatic solvent (i.e., xylene), and in the presence of a hydrocarbyl alcohol such as methanol.

The degree of overbasing may be controlled by the quantity of the alkaline earth metal hydroxide, carbon dioxide and the reactants added to the reaction mixture and the reaction conditions used during the carbonation process.

The weight ratios of reagents used (methanol, xylene, slaked lime and $CO_2$) will correspond to the following weight ratios: Xylene:slaked lime from about 1.5:1 to 7:1, preferably from about 2:1 to 4:1. Methanol:slaked lime from about 0.25:1 to 4:1, preferably from about 0.4:1 to 1.2:1. Carbon dioxide:slaked lime from a molar ratio about 0.5:1 to 1.3:1, preferably from about 0.7:1 to 1.0:1. $C_1$-$C_4$carboxylic acid: alkaline metal base alkylhydroxybenzoate a molar ratio from about 0.02:1 to 1.5:1, preferably from about 0.1:1 to 0.7:1.

Lime is added as a slurry (i.e., as a pre-mixture of lime, methanol, xylene) and $CO_2$ is introduced over a period of 1 hour to 4 hours, at a temperature between about 20° C. and 65° C.

The quantity of lime and $CO_2$ are adjusted in order to obtain for a high overbased material (TBN>250) and crude sediment in the range of 0.4 volume % to 3 volume %, preferably in the range of 0.6 volume % to 1.8 volume %, without any deterioration of the performance.

For a middle overbased material (TBN from 100 to 250), the quantity of lime and $CO_2$ are adjusted in order to obtain a crude sediment in the range of 0.2 volume % to 1 volume %. The crude sediment without the use of $C_1$-$C_4$ carboxylic acid will range from about 0.8 volume % to 3 volume %.

Optionally, for each of the processes described above, predistillation, centrifugation and distillation may be utilized to remove solvent and crude sediment. Water, methanol and a portion of the xylene may be eliminated by heating between 110° C. to 134° C. This may be followed by centrifugation to eliminated unreacted lime. Finally, xylene may be eliminated by heating under vacuum in order to reach a flash point of at least about 160° C. as determined with the Pensky-Martens Closed Cup (PMCC) Tester described in ASTM D93.

Lubricating Oil Composition

The present invention also relates to lubricating oil compositions containing the overbased alkylated hydroxyaromatic carboxylate detergent of the present invention. Such lubricating oil compositions will comprise a major amount of a base oil of lubricating viscosity and a minor amount of the overbased alkylated hydroxyaromatic carboxylate detergent of the present invention.

Base oil as used herein is defined as a base stock or blend of base stocks which is a lubricant component that is produced by a single manufacturer to the same specifications (independent of feed source or manufacturer's location); that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100° C. and about 4 centistokes (cSt) to about 20 cSt. Hydrocarbon synthetic oils may include, for example, oils prepared from the polymerization of ethylene, polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity about 20 cSt or higher at about 100 C. Oils used as the base oil will be selected or blended depending on the desired end use and the additives in the finished oil to give the desired grade of engine oil, e.g. a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Saturates levels and viscosity indices for Group I, II and III base oils are listed in Table I. Group IV base oils are polyalphaolefins (PAO). Group V base oils include all other base oils not included in Group I, II, III, or IV. Group III base oils are preferred. TABLE-US-00001 TABLE I Saturates, Sulfur and Viscosity Index of Group I, II, III, IV and V Base Stocks Saturates (As determined by ASTM D2007) Viscosity Index Sulfur (As determined by ASTM (As determined by ASTM D4294, Group D2270) ASTM D4297 or ASTM D3120) I Less than 90% saturates and/or Greater than or equal to 80 and Greater than to 0.03% sulfur less than 120 II Greater than or equal to 90% Greater than or equal to 80 and saturates and less than or equal to 0.03% less than 120 sulfur III Greater than or equal to 90% Greater than or equal to 120 saturates and less than or equal to 0.03% sulfur IV All Polyalphaolefins (PAOs) V All others not included in Groups I, II, III, or IV Natural lubricating oils may include animal oils, vegetable oils (e.g., rapeseed oils, castor oils and lard oil), petroleum oils, mineral oils, and oils derived from coal or shale.

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from C.sub.5 to C.sub.12 monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil in the lubricating oil composition of the present invention. A major amount of base oil as defined herein comprises 40 wt or more. Preferred amounts of base oil comprise from about 40 wt % 97 wt %, preferably greater than from about 50 wt % to 97 wt %, more preferably from about 60 wt % to 97 wt % and most preferably from about 80 wt % to 95 wt % of the lubricating oil composition. (When weight percent is used herein, it is referring to weight percent of the lubricating oil unless otherwise specified.)

The overbased alkali metal alkylhydroxybenzoate produced by the process of the present invention in the lubricating oil composition will be in a minor amount compared to the base oil of lubricating viscosity. Generally, it will be in an amount from about 1 wt % to 25 wt %, preferably from about 2 wt % to 12 wt % and more preferably from about 3 wt % to 8 wt %, based on the total weight of the lubricating oil composition.

Other Additive Components

The following additive components are examples of components that can be favorably employed in combination with the lubricating additive of the present invention. These examples of additives are provided to illustrate the present invention, but they are not intended to limit it.

(A) Ashless Dispersants

Alkenyl succinimides, alkenyl succinimides modified with other organic compounds, and alkenyl succinimides modified with boric acid, alkenyl succinic ester.

(B) Oxidation Inhibitors

1) Phenol type phenolic) oxidation inhibitors: 4,4'-methylenebis(2,6-di-tert-butylphenol), 4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-.alpha.-dimethylamino-p-cresol, 2,6-di-tert-4(N.N' dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl).

2) Diphenylamine type oxidation inhibitor: alkylated diphenylamine, phenyl-.alpha.-naphthylamine, and alkylated .alpha.-naphthylamine.

3) Other types: metal dithiocarbamate (e.g., zinc dithiocarbamate), and methylenebis(dibutyldithiocarbamate).

(C) Rust Inhibitors (Anti-Rust agents)

1) Non ionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate.

2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

(D) Demulsifiers

Addition product of alkylphenol and ethyleneoxide, polyoxyethylene alkyl ether, and polyoxyethylene sorbitane ester.

(E) Extreme Pressure Agents (EP Agents)

Zinc dialkyldithiophosphate (Zn-DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

(F) Friction Modifiers

Fatty alcohol, fatty acid, amine, borated ester, and other esters (G) Multifunctional Additives Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

(H) Viscosity Index Improvers

Polymethacrylate type polymers, ethylene-propylene copolymers, styrene-isoprene copolymers, hydrated styrene-isoprene copolymers, polyisobutylene, and dispersant type viscosity index improvers.

(I) Pour-Point Depressants

Polymethyl methacrylate.

(J) Foam Inhibitors

Alkyl methacrylate polymers and dimethyl silicone polymers.

(K) Metal Detergents

Sulfurized or unsulfurized alkyl or alkenyl phenates, alkyl or alkenyl aromatic sulfonates, calcium sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multi-acid, and chemical and physical mixtures thereof.

Other embodiments will be obvious to those skilled in the art.

The following examples are presented to illustrate specific embodiments of this invention and are not to be construed in any way as limiting the scope of the invention.

EXAMPLE 1

Low Temperature Performance of C20-28 and C20-24 Carboxylates in an Automotive Engine Oil Formulation Table 1.1 illustrates the low temperature performance of five carboxylate detergents as measured in the ASTM D 4684 (−35° C., MRV) test in a fully formulated automotive engine oil prepared using the following automotive engine oil additive package and base oil blend:

| Automotive Engine Oil Additive Package | |
|---|---|
| Additive | Treat Rate |
| Borated Bis-Succinimide | 3.0 wt. % |
| Post Treated (Ethylene Carbonate) Bis-Succinimide | 5.0 wt. % |
| Non-Carbonated Calcium Sulfonate | 8 mmol Ca/kg in finished oil |
| Post Treated (PthalicAcid) Bis-Succinimide | 0.4 wt. % |
| Zinc Dithiophosphate | 12.5 mmol P/kg in finished oil |
| Molybdenum Succinimide Complex | 0.4 wt. % |
| Aminic Antioxidant | 0.5 wt. % |
| Phenolic Antioxidant | 0.5 wt. % |
| Foam Inhibitor | 30 ppm in finished oil |
| Carboxylate Detergent | 56 mmol Ca/kg in finished oil |

This package was blended at 15.2 weight % in the following base oil blend to make a 5W40 multigrade finished oil:

| Base Oil Blend | |
|---|---|
| Component | % |
| Group III Base Oil 1 | 52.2 |
| Group III Base Oil 2 | 20.3 |
| Pourpoint Depressant | 0.3 |
| Viscosity Index Improver | 12.0 |

The data in Table 1.1 shows that as the percent branching in the alkylchain on the alkylphenol used to prepare the carboxylate detergent increases, the MRV performance is improved.

TABLE 1.1

| | Carboxylate | | | Carboxylate | |
|---|---|---|---|---|---|
| | 8086 | 8080 | Comparative Example 8068 | 8082 | Comparative Example 8053 |
| Carboxylate TBN | 350 | 353 | 373 | 367 | 357 |
| Alkylphenol[1] Used to Prepare Carboxylate (Reference Number) | 5631 | 9415 | 200H | 5502 | 200J |
| Carbon Number of the Alkyl Tail in the Alkylphenol | 20-24/26-28 (80:20) | 20-24/26-28 (80:20) | 20-24/26-28 (80:20) | 20-24 | 20-24 |
| % Branching in the Olefin Used to Prepare the Alkylphenol | 79.6 | 26.2 | About 0 | 22.4 | 6.8 |
| MRV Results | | | | | |
| Yield Stress (Pa) | 0 < Y <= 35 | 140 < Y <= 175 | 175 < Y <= 210 | 175 < Y <= 210 | Y > 350 |
| Viscosity (cP@ −35° C. | 32,210 | 115,310 | 233,100 | 106,380 | Frozen |

[1]Alkylphenol Reference Numbers (e.g., 5631, 200J etc.) are described in Examples that follow.

EXAMPLE 18

Low Temperature Performance of C20-28 and C20-24 Carboxylates in an Automotive Engine Oil Formulation Table 18.1 summarizes the low temperature performance of four carboxylate detergent in the following finished automotive engine oil as measured by the ASTM D 4684 (−30° C., MRV). The data in Table 18.1 shows that as the percent branching in the alkylchain on the alkylphenol used to prepare the carboxylate detergent increases, the MRV performance is improved.

| Finished Automotive Engine Oil Blends | | |
|---|---|---|
| Carboxylate | mmol Ca | 35 |
| Bis Succinimide | Wt. % | 6.5 |
| Non Carbonated Calcium Sulfonate | mmol Ca | 4.0 |
| Carbonated Calcium Phenate | mmol Ca | 10.0 |
| Zinc Dithiophosphate | mmol P | 11.5 |
| Molybdenum Succinimide Complex | Wt. % | 0.367 |
| Aminic Antioxidant | Wt. % | 0.4 |
| Foam Inhibitor | ppm | 25 |
| Group III Base Oil 1 | Wt. % | 42.16 |
| Group III Base Oil 2 | Wt. % | 45.68 |
| Viscosity Index Improver | Wt. % | 1.26 |

TABLE 18.1

| | C20-28 Alkylphenol Carboxylate | | C20-24 Alkylphenol Carboxylate | |
|---|---|---|---|---|
| | 8080 | Comparative Example 8068 | 8082 | Comparative Example 8053 |
| % Branching in Alkylchain of the olefin used to make the Alkylphenol Used to Make Carboxylate | 26.2 | 0 | 22.4 | 6.8 |
| TBN of the Carboxylate Detergent | 353 | 373 | 367 | 357 |
| MRV Results | | | | |
| Viscosity (cP @ −30° C.) | 79500 | >400000 | 80900 | 284700 |
| Yield Stress (Pa) | <245 | >350 | <315 | >315 |

EXAMPLE 2

Measurement of % Branching and % Alpha-Olefin in C20-24 Isomerized Alpha Olefins (IAO)

Infrared spectrometry is used to determine the percentage methyl branching and percentage residual alpha-olefin of isomerized C20-24 NAO or isomerized alpha olefin (IAO). The technique involves developing a calibration curve between the infrared absorption at 1378 cm-1 (characteristic of the methyl stretch) measured by attenuated reflectance (ATR) infrared spectrometry and the percent branching determined by GLPC analysis of the corresponding hydrogenated IAO samples (hydrogenation converts the IAO to a mixture of paraffin's in which the normal paraffin has the longest retention time for a give carbon number). Similarly, a calibration curve was developed between the infrared absorption at 907 cm−1 (characteristic of alpha olefin C—H stretch) determined by attenuated reflectance (ATR) infrared spectrometry and the percent alpha-olefin determined by quantitative carbon NMR.

A linear least squares fit of data for the percent branching showed the following equation:

% Branching by Hydrogenation GC=3.0658 (Peak Height at 1378 cm-1, in mm, by ATR Infrared Spectroscopy)−54.679. The R2 was 0.9321 and the branching content of the samples used to generate this calibration equation ranged from approximately 9% to 92%.

Similarily, a linear least squares fit of the percent alpha-olefin data showed the following equation:

% Alpha-Olefin by Carbon NMR=0.5082 (Peak Height at 909 cm-1, in mm, by ATR Infrared Spectroscopy)−2.371. The R2 was 0.9884 and the alpha-olefin content of the samples used to generate this calibration equation ranged from approximately 1% to 75%.

EXAMPLE 3

Preparation of Isomerized C20-28 (C20-24/C26-28 (80:20)) Alpha Olefin

The primary olefinic species in Normal Alpha Olefins (NAO's) is normally alpha-olefin. The isomerization of NAO's over the solid acid extrudate catalyst ICR 502 (purchased from Chevron Lunmmnus Global) isomerizes the alpha-olefin to other olefinic species, such as beta-olefins, internal olefins and even tri-substituted olefins. The isomerization of NAO's over ICR 502 catalyst also induces skeletal isomerization in which methyl groups are introduced along the hydrocarbon chain of the isomerized alpha olefin (IAO) which is referred to as branching. The branching content of IAO's is monitored by Infrared spectrometry (Example 2). The degree of olefin and skeletal isomerization of an NAO depends on the conditions of the isomerization process. A mixture of C20-24/C26-28 (80:20 by weight) obtained from Chevron Phillips Chemical Company was isomerized in a tubular fixed bed reactor (2.54 cm ID×54 cm Length Stainless Steel) packed sequentially from the bottom of the reactor to the top of the reactor as follows; 145 grams Alundum 24, 40 grams of ICR 505 mixed with 85 grams of Alundum 100, 134 grams of Alundum 24. The reactor was mounted vertically in a temperature controlled electric furnace. The catalyst was dried at approximately 150° C. in a downflow of dry nitrogen of approximately 30 ml/minute. The NAO (heated to approximately 35° C.) was pumped upflow at a WHSV of 1.5 while the catalyst bed was held at temperatures ranging between 130° C. and 230° C. at atmospheric pressure and samples of IAO were collected at the outlet of the reactor with different amounts of branching depending on the reactor temperature.

EXAMPLE 4

Preparation of Alkylphenol 9415

To a 10 liter, glass, four neck flask fitted with a mechanical stirrer, reflux condenser and thermocouple under a dry nitrogen atmosphere was charged 3000 grams of melted phenol (42.5 moles) followed by 2200 grams (6.5 moles) of the isomerized C20-28 alpha-olefin from Example 3 containing 26.2% Branching. To this gently stirring mixture was added 770 grams of Amberlyst 36® acidic ion exchange resin obtained from Rohm and Hass (dried approximately 25 hours in an oven at 110° C. The reaction temperature was increased to 120° C. and held for about 19 hours at which time the conversion was 99.1% (by Supercritical Fluid Chromatography). The product was filtered through a Buchner funnel with the aid of vacuum and the filtrate combined with that of previous reactions to afford approximately 1.3 kg of product. This product was vacuum distilled (98 to 108° C. at 50 Torr vacuum, then 94° C. at 30 Torr vacuum and then finally 94-204° C. at 1.0 Torr vacuum to afford 8638 grams of the alkylphenol 9415 with the following properties: 1.7% Unreacted olefin/paraffin, 13.2% Di-alkylate by Supercritical Fluid Chromatography; 57% para-alkyl isomer by IR; 1.3% Ether, 10.1% Di-Alkylate, 52.2% para-alkyl-isomer, 0.04% free phenol, 1.3% Unreacted olefin/paraffin by HPLC.

EXAMPLE 5

Preparation of Alkylphenol 200H

The alkylphenol 200H is a commercial alkylphenol made from a mixture of unisomerized C20-24/C26-28 NAO (80:

20) obtained from Chevron Phillips Chemical Company. Alkyklphenol 200H had the following properties: 1.0% Ether, 3.5% Di-alkylate, 35.9% Para-alkyl-isomer, 0.8% free phenol and 0.8% Unreacted olefin/paraffin by HPLC.

EXAMPLE 6

Preparation of Isomerized/Branched C20-24 Alpha Olefin

To a 3.0 liter, three neck round bottom flask fitted with a mechanical stirrer and reflux condenser under a dry nitrogen atmosphere was added approximately 1600 grams of melted C20-24 NAO obtained from Chevron Phillips Company. This solution was warmed to approximately 40° C. and then approximately 1.2 ml of iron pentacarbonyl was added via syringe. The reaction was heated to 190° C. and monitored by Infrared Spectroscopy until the absorptions at 990 and 910 cm-1 are minimal. The reaction was cooled to approximately 30° C. and then about 50 grams of silica gel was added to the reaction followed by about 1 ml of methanesulfonic acid. The flask was heated to 90° C. and periodic testing of aliquots by filtering through a 0.5 micron filter (Millipore) and heating to 250° C. on a hot plate and watching for discoloration. When aliquots no longer discoloured by this periodic testing (approximately 12 hours), the reaction was cooled to room temperature and product was washed with water, dried over anhydrous NaSO4 and filtered to afford an isomerized C20-24 with the following properties: 12% Branching, <1% Residual alpha-olefin by IR; 0.4% alpha-olefin, 21.5% beta-olefin, 2.2% tri-substituted olefin, 97.3% internal-olefin by Carbon NMR.

EXAMPLE 7

Preparation of Alkylphenol 5502

Following the procedure in Example 4, alkylphenol 5502 was prepared from the isomerised C20-24 NAO obtained from Example 6 to afford alkylphenol 5502 with the following properties: 3.5% Unreacted olefin/paraffin, 9.9% Di-alkylate by SFC; 39% para-alkyl-isomer by IR; 0.4% ether, 5.0% Di-Alkylate, 69.6% para-alkyl-isomer, 0.18% free phenol and 1.0% Unreacted olefin/paraffin by HPLC.

EXAMPLE 8

Preparation of Alkylphenol 200J

The alkylphenol 200J was prepared as in Example 4 using unisomerized C20-24 NAO obtained from Chevron Phillips Chemical Company. Alkylphenol 200J had the following properties: 2.7% Unreacted olefin/paraffin, 7.1% Di-alkylate by SFC; 40% Para-alkyl-isomer by IR; 2.2% Ether, 4.9% Di-alkylate, 36.9% Para-alkyl-isomer, 0.5% free phenol and 2.3% Unreacted olefin/paraffin by HPLC.

EXAMPLE 9

Preparation of Alkylphenol 5631

Following the procedure of Example 4, alkylphenol 5631 was prepared from a mixture of isomerized C20-24/26-28 (80:20) alpha olefin containing 79.6% branching obtained from Example 3 to afford an alkylphenol with the following properties: 0.4% Ether, 10.1% Di-alkylate, 52.2% Pra-alkyl-isomer, 0.04% free phenol and 1.3% unreacted olefin/paraffin by HPLC.

EXAMPLE 10

Neutralization of Alkylphenol 9415 to Prepare the Corresponding Potassium Salt

The alkylphenol 9415 of Example 3 (1500 grams, 3.48 moles) was charged to a 4 liter round bottom, four neck flask equipped with a Dean Stark trap and condenser followed by 750 g of mixed xylenes and 0.2 g of foam inhibitor. The mixture was heated to 60° C. over 15 minutes with agitation and then 451.1 grams (3.48 moles corrected for purity) of 50 wt % aqueous KOH solution was added over 10 minutes. This mixture was then heated to 135° C. over 150 minutes. At the beginning of this temperature ramp to 135° C., the pressure was reduced to 450 mm Hg. The resulting refluxing xylenes were maintained at reflux for an additional 3 hours at which point 330 ml of water was recovered from the Dean Stark trap. The reaction was then cooled to room temperature and kept under an atmosphere of dry nitrogen. Analysis of this liquid showed the presence of water=223 ppm and Total Base Number=81.3.

EXAMPLE 11

Carboxylation of the Potasium Salt of Alkylphenol 9415

The potassium alkylphenol salt xylene solution obtained from Example 10 was heated to 100° C. and transferred to a 4 liter stainless steel pressure reactor. The contents of the reactor was heated to 140° C. and $CO_2$ was bubbled through the product until the reactor reached 3 bar of pressure. The reaction was held at 140° C. and a constant pressure of 3 bar of $CO_2$ for 4 hours. The contents of the reactor was cooled to approximately 100° C. to afford a xylene solution of the potassium carboxylate with the following properties: 30% xylene by mass balance; Carboxylic Acid=64.2 mg KOH/gram of sample by titration.

EXAMPLE 12

Acidification of the Potassium Carboxylate Derived from Alkylphenol 9415

The potassium carboxylate xylene solution (1100 grams) obtained from Example 11 was poured into a 4 liter, round bottom four neck flask fitted with a mechanical stirrer, reflux condenser, thermometer under a dry nitrogen atmosphere at room temperature followed by 647 grams of mixed xylenes. To this mixture was added 1006 grams of 10 wt. % aqueous $H_2SO_4$ over 30 minutes with stirring. During this time, the reaction was heated to 60° C. The product was transferred to a separatory funnel and allowed to stand approximately 2 hours to allow phase separation at which time 1679.5 grams of the organic phase was obtained with the following properties: Carboxylic Acid=40.8 mg KOH/gram of sample by titration; 60.4% xylene by mass balance; Water=339 ppm; K=116 ppm.

EXAMPLE 13

Overbasing of the Carboxylic Acid Derived from Alkylphenol 9415 to Prepare Carboxylate 8080

The overbasing of the carboxylic acid is accomplished in two steps: Neutralization and Carbonation followed by Pre-distillation, Centrifugation and Final Distillation.

Neutralization and Carbonation

A slurry of lime (272.9 grams), methanol (226.7 grams) and mixed xylenes (370 grams) is added to a jacketed, glass, 4 liter, four neck reactor fitted with a mechanical stirrer, gas inlet tube and reflux condenser at room temperature. To this mixture was added 1244.1 grams of the carboxylic acid xylene solution obtained from Example 12 over 15 minutes with stirring while heating the mixture to 28° C. The temperature of the reaction is then heated to 40° C. over 15 minutes and then 13.9 grams of a mixture (50:50 by weight) of formic acid/acetic acid is added to the flask. The temperature of the reaction increased to 43° C. and was allowed to stir 5 minutes. The reaction mixture was then cooled to 30° C. over 20 minutes and then CO2 gas (9.8 grams) was added to the reaction over 11 minutes at which time the temperature increased to 32° C. CO2 (81.6 grams) was added to the reaction over 75 minutes and the reaction temperature increased to 48° C. A second slurry of lime (51.9 grams), methanol (42.9 grams) and mixed xylenes (260 grams) was added to the flask. CO2 (61.1 grams) was added to the reaction over 57 minutes at which time the reaction temperature increased to 60° C.

Predistillation, Centrifugation and Final Distillation

The methanol, water and a portion of the xylenes was removed by distillation. The reflux condenser to a distillation head and the reaction temperature was increased to 128° C. over 110 minutes. When the reaction reached 128° C., 422.5 grams of oil (100 Neutral) was added with stirring. A sample of the reaction showed a crude sediment=2.8 vol %. This product was centrifuged to remove the solids present (Alfa Laval Gyrotester) and the resulting solution vacuum distilled to removed the remaining xylenes (204° C. at 60 mbar) to afford the final carboxylate product with the following properties: % Ca=12.59%, Viscosity (100° C.)=133 cSt, Carboxylic Acid=34.4 mg KOH/gram of sample by titration and Potassium=127 ppm, Total Base Number=353.

EXAMPLE 14

Preparation of the Carboxylate 8086 from Alkylphenol 5631

The procedure in Examples 10, 11, 12 and 13 were followed to prepare the carboxylate 8086 starting with the alkylphenol 5631 from Example 9 to afford the final carboxylate with the following properties: % Ca=12.49%, Viscosity (100° C.)=157 cSt, Carboxylic Acid=35.1 mg KOH/gram of sample by titration and Potassium=33 ppm and Total Base Number=350.

EXAMPLE 15

Preparation of the Carboxylate 8082 from Alkylphenol 5502

The procedure in Examples 10, 11, 12 and 13 were followed to prepare the carboxylate 8082 starting with the alkylphenol 5502 from Example 7 to afford the final carboxylate with the following properties: % Ca=12.58%, Viscosity (100° C.)=58.6 cSt, Carboxylic Acid=36.3 mg KOH/gram of sample by titration and Potassium=14 ppm and Total Base Number=350.

EXAMPLE 16

Preparation of Carboxylate 8053 from Alkylphenol 200J

The procedure in Examples 10, 11, 12 and 13 were followed to prepare the carboxylate 8053 starting with the alkylphenol 200J from Example 8 to afford the final carboxylate with the following properties: % Ca=12.66%, Viscosity (100° C.)=52.5 cSt, Carboxylic Acid=35.7 mg KOH/gram of sample by titration and Potassium=136 ppm and Total Base Number=357.

EXAMPLE 17

Preparation of Carboxylate 8068 from Alkylphenol 200H

The carboxylate 8068 is a commercial product obtained from Chevron Oronite LLC and has the following properties: % Ca=12.5, Viscosity (100° C.)=180 cSt, Carboxylic Acid=37.0 mg KOH/gram of sample by titration and Potassium=<100 ppm and Total Base Number=353.

What is claimed is:

1. An overbased alkylated hydroxyaromatic carboxylate detergent prepared by the process comprising (a) alkylating a hydroxyaromatic compound with at least one normal alpha olefin having from about 12 to about 30 carbon atoms per molecule that has been isomerized to obtain an isomerized alpha olefin having at least about 23%-98 wt % branching and a residual alpha olefin content of between from at least about 9 wt % to about 30 wt %, thereby producing an alkylated hydroxyaromatic compound;

(b) neutralizing the resulting alkylated hydroxyaromatic compound with an alkali metal base to provide an alkali metal salt of the alkylated hydroxyaromatic compound;

(c) carboxylating the alkali metal salt from step (b) with carbon dioxide thereby producing an alkylated hydroxyaromatic carboxylic acid alkali metal salt;

(d) acidifying the salt produced in step (c) with acid to produce the alkylated hydroxyaromatic carboxylic acid; and (e) overbasing the alkylated hydroxyaromatic carboxylic acid with lime in the presence of carbon dioxide thereby producing an overbased alkylated hydroxyaromatic carboxylase detergent having the following structure:

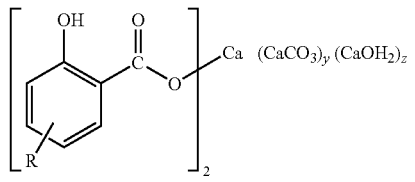

wherein R is an alkyl group derived from said isomerized alpha olefins and wherein y and z are independently whole or partial integers; and further wherein said overbased alkylated hydroxyaromatic carboxylate detergent has a TBN of greater than 250.

2. The carboxylate detergent of claim 1 wherein the isomerized alpha olefin is a partially isomerized olefin containing a residual alpha olefin content, wherein when the percent branching in the partially isomerized alpha olefin is less than or equal to 25 weight percent, then the residual alpha olefin content in such partially isomerized alpha olefin is greater than or equal to 8 weight percent.

3. The carboxylate detergent of claim 1 wherein the isomerized alpha olefin has 30-80 wt % branching.

4. The carboxylate detergent of claim 3 wherein the isomerized alpha olefin has 45-70 wt % branching.

5. The carboxylate detergent of claim 3 wherein the isomerized alpha olefin has 50-60 wt % branching.

6. The carboxylate detergent of claim 1 wherein the normal alpha olefin mixture has from about 14 to about 28 carbon atoms per molecule.

7. The carboxylate detergent of claim 1 wherein the normal alpha olefin mixture has from about 18 to about 24 carbon atoms per molecule.

8. A lubricating oil composition comprising an oil of lubricating viscosity and the carboxylate detergent prepared by the process of claim 1.

9. An overbased carboxylate detergent having the following structure:

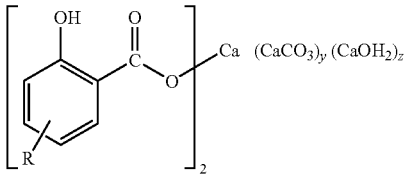

wherein R is an alkyl group derived from an isomerized alpha olefin having from about 12 to about 30 carbon atoms per molecule, having at least about 23%-98 wt % branching and a residual alpha olefin content of between from at least about 9 wt % to about 30 wt %; and wherein y and z are independently whole or partial integers, and further wherein said overbased carboxylate detergent has a TBN of greater than 250.

10. A method for improving the low temperature performance of a lubricating oil composition comprising a major amount of an oil of lubricating viscosity, the method comprising the step of adding to the lubricating oil composition an overbased alkylated hydroxyaromatic carboxylate detergent prepared by the process comprising (a) alkylating a hydroxyaromatic compound with at least one normal alpha olefin having from about 12 to about 30 carbon atoms per molecule that has been isomerized to obtain an isomerized alpha olefin having at least about 23%-98 wt % branching and a residual alpha olefin content of between from at least about 9 wt % to about 30 wt %, thereby producing an alkylated hydroxyaromatic compound, (b) neutralizing the resulting alkylated hydroxyaromatic compound with an alkali metal base to provide an alkali metal salt of the alkylated hydroxyaromatic compound;

(c) carboxylating the alkali metal salt from step (b) with carbon dioxide thereby producing an alkylated hydroxyaromatic carboxylic acid alkali metal salt;

(d) acidifying the salt produced in step (c) with acid to produce the alkylated hydroxyaromatic carboxylic acid; and (e) overbasing the alkylated hydroxyaromatic carboxylic acid with lime in the presence of carbon dioxide thereby producing an overbased alkylated hydroxyaromatic carboxylate detergent having the following structure:

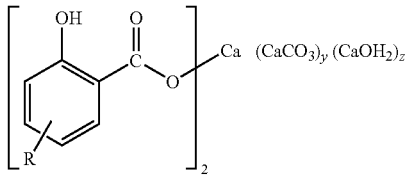

wherein R is an alkyl group derived from said isomerized alpha olefins and wherein y and z are independently whole or partial integers; and further wherein said overbased alkylated hydroxyaromatic carboxylate detergent has a TBN of greater than 250.

11. The method according to claim 10 wherein the isomerized alpha olefin is a partially isomerized olefin containing a residual alpha olefin content, wherein when the percent branching in the partially isomerized alpha olefin is less than or equal to 25 weight percent, then the residual alpha olefin content in such partially isomerized alpha olefin is greater than or equal to 8 weight percent.

12. The method according to claim 10 wherein the isomerized alpha olefin has 30-80 wt % branching.

13. The method according to claim 12 wherein the isomerized alpha olefin has 45-70 wt % branching.

14. The method according to claim 12 wherein the isomerized alpha olefin has 50-60 wt % branching.

15. The method according to claim 10 wherein the normal alpha olefin mixture has from about 14 to about 28 carbon atoms per molecule.

16. The method according to claim 10 wherein the normal alpha olefin mixture has from about 18 to about 24 carbon atoms per molecule.

* * * * *